US007344428B2

(12) United States Patent
Ransil et al.

(10) Patent No.: US 7,344,428 B2
(45) Date of Patent: Mar. 18, 2008

(54) MOTION CONVERSION MECHANISM FOR USE WITH CHILD CONTAINMENT STRUCTURE

(75) Inventors: Matthew J. Ransil, Richland, PA (US); Nicholas E. Papageorge, Upper Darby, PA (US); Dennis R. Stauffer, Birdsboro, PA (US)

(73) Assignee: Graco Children's Products Inc., Exton, PA (US)

( * ) Notice: Subject to any disclaimer, the term of this patent is extended or adjusted under 35 U.S.C. 154(b) by 225 days.

(21) Appl. No.: 11/103,650

(22) Filed: Apr. 12, 2005

(65) Prior Publication Data

US 2005/0239565 A1 Oct. 27, 2005

Related U.S. Application Data

(60) Provisional application No. 60/560,966, filed on Apr. 12, 2004.

(51) Int. Cl.
*A63H 33/26* (2006.01)

(52) U.S. Cl. ..... 446/227; 472/119

(58) Field of Classification Search ..... 472/118–125; 5/101, 105–110; 446/227
See application file for complete search history.

(56) References Cited

U.S. PATENT DOCUMENTS 5,083,773 A * 1/1992 Saint ..... 472/119
5,378,196 A * 1/1995 Pinch et al. ..... 472/119
5,803,817 A 9/1998 Stern
6,027,409 A 2/2000 Favorito et al.
6,386,986 B1 5/2002 Sonner et al.
6,645,080 B1 11/2003 Greger et al.
6,877,802 B2 4/2005 Christensen et al.
2003/0199328 A1 10/2003 Wood et al.
2004/0259647 A1 12/2004 Wood et al.
2005/0014443 A1* 1/2005 Bapst et al. ..... 446/227

FOREIGN PATENT DOCUMENTS

CA 2 464 495 A1 11/2004

OTHER PUBLICATIONS

Fisher Price Flutterbye Dreams™ Swing, Advertisement, www.fisherprice.com, 2 pages, 2005.
Four Photographs of Portions of Fisher Price Flutterbye Dreams™ Swing, 4 pages.
Instruction Manual for Fisher-Price Mobile Swing Model Nos. C1383, C4934 and C4643.
Collection of photographs of the Fisher-Price Mobile Swing Model No. C1383 toy bar.

* cited by examiner

*Primary Examiner*—Kien Nguyen
(74) *Attorney, Agent, or Firm*—Lempia Braidwood LLC

(57) ABSTRACT

A motion conversion mechanism is described. The motion conversion mechanism includes a first member and an a second member. The firs member is configured to be arranged relative to the child containment structure to undergo motion in a first angular direction and in a second angular direction opposite to the first angular direction. The second member includes a rotation device that is rotatable about a rotation axis. The first and second members configured in combination to convert motion about the angular motion axis to motion of the rotation device about the rotation axis when the first member moves in at least one of the first angular direction and in the second angular direction.

35 Claims, 15 Drawing Sheets

MOTION CONVERSION MECHANISM FOR USE WITH CHILD CONTAINMENT STRUCTURE

RELATED APPLICATIONS

This application claims the benefit of U.S. Provisional Application No. 60/560,966, filed Apr. 12, 2004, which is incorporated by reference herein in its entirety.

FIELD OF THE INVENTION

This invention relates to a motion conversion mechanism. More specifically, this invention relates to a motion conversion mechanism that may be used for providing motion to a child toy, such as a mobile, on a child containment structure, such as child swing.

BACKGROUND OF THE INVENTION

Child containment structures, such as a child swing, are known to be equipped with a mobile with toys attached for the enjoyment of the child using the swing. Typically, the mobile is attached to some portion of the swing and hangs down toward the child seating area. For example, one swing provides a non-motorized mobile in which forward motion of the swing can impart motion to the mobile.

SUMMARY OF THE INVENTION

One aspect of the invention relates to a motion conversion mechanism for use with a child containment structure. The motion conversion member comprises: a first member configured to be arranged relative to the child containment structure to undergo motion in a first angular direction and in a second angular direction opposite to the first angular direction; and a second member including a rotation device that is rotatable about a rotation axis, the first and second members configured in combination to convert motion about the angular motion axis to motion of the rotation device about the rotation axis when the first member moves both in the first angular direction and in the second angular direction.

Another aspect of the invention relates to a child entertainment structure. The child entertainment structure comprises: a child entertainment structure comprising a support adapted to undergo motion in a first angular direction and a second angular direction opposite to the first angular direction; and a motion conversion mechanism. The motion conversion mechanism comprises: a first member attached to the support; and a second member including a rotation device that is rotatable about a rotation axis, the first and second members configured in combination to convert motion about the angular motion axis to motion of the rotation device about the rotation axis when the support moves both in the first angular direction and in the second angular direction.

Yet another aspect of the invention relates to a motion conversion mechanism for use with a child containment structure. The motion conversion mechanism comprises: a first member configured to be arranged relative to the child containment structure to undergo motion in a first angular direction and in a second angular direction opposite to the first angular direction; a second member including a primary rotation device that is rotatable about a primary rotation axis, the first and second members configured in combination to convert motion about the angular motion axis to motion of the primary rotation device about the primary rotation axis when the first member moves in at least one of the first angular direction and the second angular direction; and an auxiliary rotation device having an auxiliary rotation axis different from the primary rotation axis, the rotational motion imparted to the primary rotation device being such as to drive the auxiliary rotation device about the auxiliary rotation axis, the auxiliary rotation axis being different from the primary rotation axis.

Yet another aspect of the invention relates to a motion conversion mechanism for use with a child containment structure. The motion conversion member comprises: a first member configured to be arranged relative to the child containment structure to undergo motion in a first angular direction and in a second angular direction opposite to the first angular direction; and a second member including a rotation device that is rotatable about a rotation axis, the first and second members configured in combination to convert motion about the angular motion axis to motion of the rotation device about the rotation axis when the first member moves in at least one of the first angular direction and in the second angular direction. The first member comprises: a first member housing configured to be attached to the support; at least one pawl; and at least one ratchet configured to engage with the at least one pawl.

It is to be understood that both the foregoing general description and the following detailed description are exemplary and explanatory only and are not restrictive of the invention, as claimed.

BRIEF DESCRIPTION OF THE DRAWINGS

The accompanying drawings, which are incorporated in and constitute a part of this specification, illustrate several embodiments of the invention and, together with the description, serve to explain the principles of the invention.

DETAILED DESCRIPTION OF THE PREFERRED EMBODIMENTS

Reference will now be made in detail to presently preferred embodiments of the invention, examples of which are illustrated in the accompanying drawings. An effort has been made to use the same reference numbers throughout the drawings to refer to the same or like parts.

Figure 1:
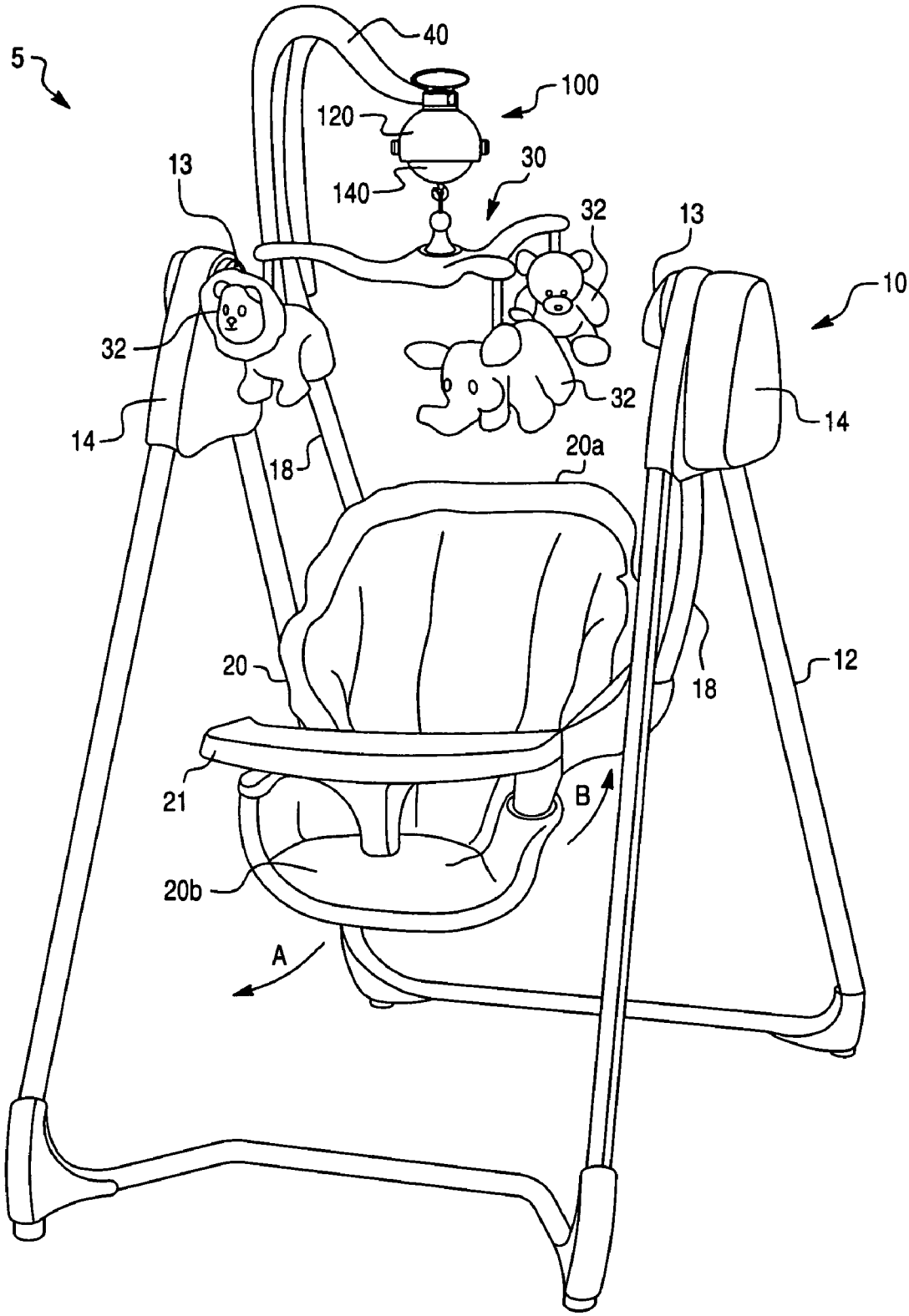
FIG. 1 illustrates a swing including a motion conversion mechanism according to an embodiment of the present invention.

FIG. 1 illustrates a child enjoyment apparatus 5, including a child containment structure, in this case a child swing 10, and a motion conversion mechanism 100 that can be attached to the child containment structure according to an embodiment of the invention. The motion conversion mechanism 100 can be employed with any child containment structure that undergoes angular motion, such as a swing 10, to convert the angular motion of the child containment structure to motion of a toy coupled to the motion conversion mechanism 100. The motion conversion mechanism 100 can convert motion both when the child containment structure moves in a first angular direction, for example, forward swinging motion of a child swing, and in a second opposite angular direction, for example, rearward swinging motion of a child swing. In addition, the motion conversion mechanism 100 also can be attached to a support movably coupled a fixed child containment structure, such as a crib, so that angular motion of the support can be converted to motion of a toy coupled to the motion conversion mechanism 100.

The motion conversion mechanism 100 beneficially accomplishes the motion conversion without using batteries or motion. Additionally, the cost of the mechanism can be low due to the simple construction and minimal number of parts required.

The child containment structure may include a child support surface, such as the front/upper surface of the seat 20. A toy, such as mobile 30, may be a component of, or attached to, the motion conversion mechanism 100 so that the motion conversion mechanism 100 imparts motion to the toy. In the illustrated embodiment, a child seated in the seat 20 of the swing 10 may interact with one or more of a number of decorative objects 32 of the toy mobile 30.

The swing 10 generally includes a frame 12, which can include front legs, back legs, and housings 14, one of which can include a motor mechanism to drive the swing. The swing may include a seat 20 and a swing seat support. In the illustrated embodiment, the swing seat support includes one or more seat hanger arms 18 coupled to the frame 10 at hubs 13. The seat 20 includes a seat back 20*a* and a seat bottom 20*b* and may have a tray 21 attached to the seat. The seat 20 may also be provided with decorative and comfort-providing materials, such as a seat cushion mounted over the front surface of the seat back 20*a* and the seat bottom 20*b*. The seat back 20*a* may be configured to move between an upright position and several reclined positions relative to the seat bottom 20*b*. An actuator apparatus can be provided to facilitate movement of the seat back towards and away from the seat bottom 20*b*. The actuator apparatus allows the angle between the seat bottom 20*b* and seat back 20*a* to be adjusted as desired.

A mechanism support arm 40 can be attached to the swing 10 to support the motion conversion mechanism 100. When the swing seat 20 is in motion, the support arm 40 along with the motion conversion mechanism 100 moves back and forth with the swing seat 20 in angular motion about an angular motion axis. The mechanism support arm 40 may be attached to any of the moving components of the swing 10, including the hanger arms 18, the hubs 13, or the seat 20. Alternatively, the motion conversion mechanism 100 may be attached directly to any of the moving components of the swing 10 including the hanger arms 18, the hubs 13, or the seat 20, without a mechanism support arm 40.

During the swing motion, the swing seat 20 and the motion conversion mechanism 100 move back and forth alternately in a first angular direction along arrow A (in a forward direction) and in a second angular direction along arrow B (in a backward direction) opposite to the first angular direction. The motion of the swing seat 20 and the motion conversion mechanism 100 is about an angular motion axis. In the case of the swing 10, the angular motion axis is the axis through the hubs 13 about which the hubs 13 rotate. Thus, for the swing 10 shown in FIG. 1, the angular motion axis will be fixed. The invention, however, is not limited to a situation where the angular motion axis of the motion conversion mechanism 100 is fixed. The angular motion axis of the motion conversion mechanism 100 may change in time, such as when the child containment structure exhibits a rocking motion.

Figure 2:
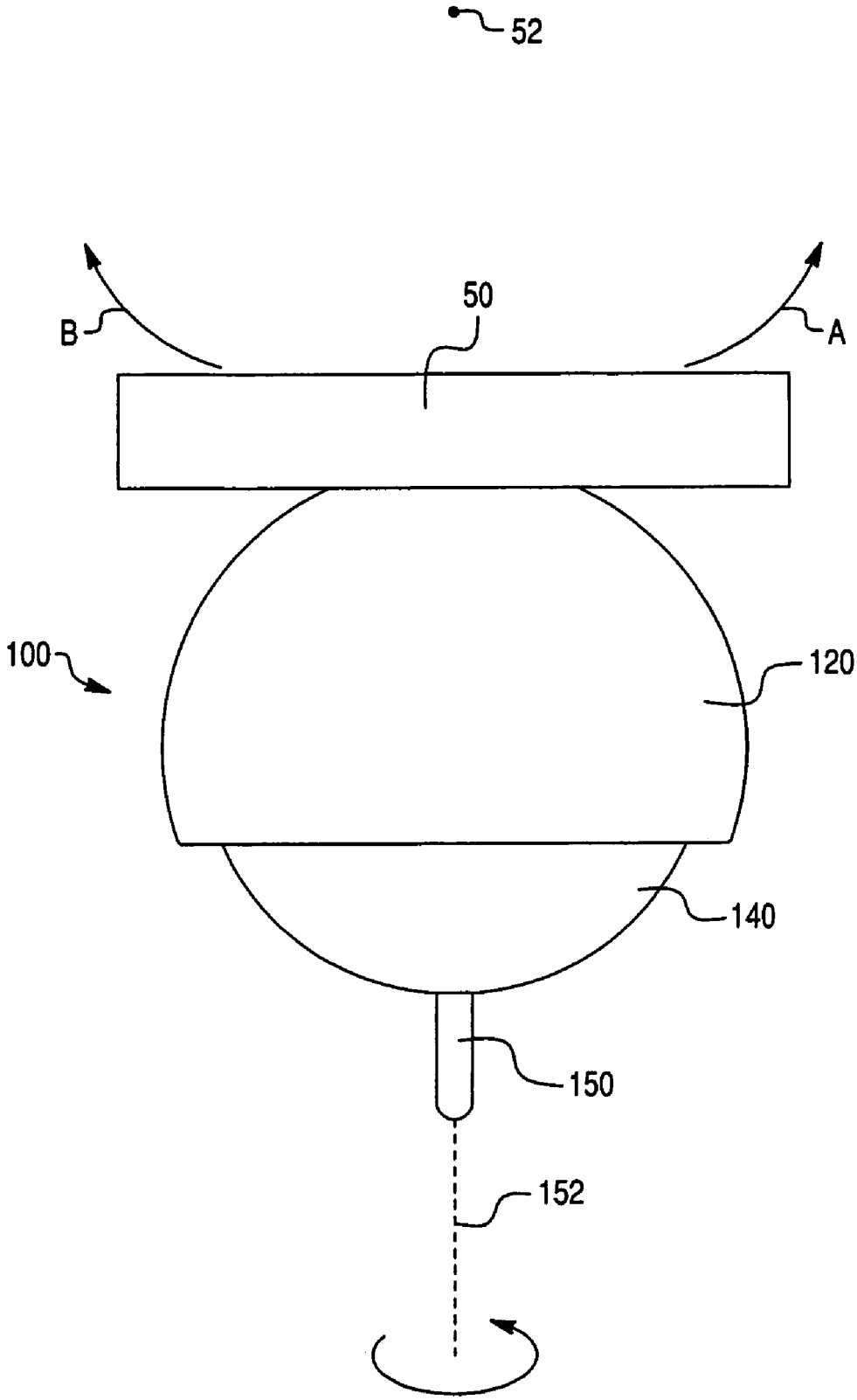
FIG. 2 is a schematic of a motion conversion mechanism attached to a support according to an embodiment of the invention.

The operation of the motion conversion mechanism 100 will now be explained with reference to FIG. 2, which illustrates a schematic of the motion conversion mechanism 100 according to an embodiment of the invention. The motion conversion mechanism 100 can be attached to a support 50 associated with the child containment structure. The support 50 can be a component of a moveable containment structure (such as a child tray of a swing), a support fixedly or releasably coupled to a moveable child containment structure (such as support arm 40 of child swing 10), or a moveable support coupled to a fixed child containment structure (such as a mechanized pivoting arm coupled to a crib). The motion conversion mechanism 100 can move back and forth alternately in a first angular direction shown by the arrow A, and in a second angular direction shown by the arrow B, where the second angular direction is opposite to the first angular direction. The motion in the first angular direction and in the second angular direction is about angular motion axis 52.

The motion conversion mechanism 100 includes a first member 120 and a second member 140, where the first member 120 is attached to the support 50.

The second member 140 includes a rotation device 150. The rotation device 150 is rotatable about a rotation axis 152. In combination, the first member 120 and the second member 140 are configured to convert motion about the angular motion axis 52 to motion of the rotation device 150 about the rotation axis 152 when the first member 120 moves in at least one of the first angular direction and in the second angular direction. Preferably, the first member 120 and the second member 140 are configured to convert motion about the angular motion axis 52 to motion of the rotation device 150 about the rotation axis 152 both when the support 50 moves in the first angular direction and in the second angular direction so that the conversion of motion is continuous.

During the motion of the first member 120 about its angular motion axis, the gravitational force on the rotation device 150 will tend to orient the rotational device 150 so that it points to the ground much like a plumb bob does. Thus, the angular orientation of the rotation device 150, and second member 140 in general, relative to the ground remains constant. In this regard, the rotation device 150 may have sufficient weight of its own, or it may require the weight of an attached object, such as a mobile for example, to orient the rotation device 150 so that it points to the ground. As the rotational device 150 orients itself toward the ground during the angular motion of the first member 120, the angular displacement of the second member 140 relative to the first member 120 changes, and second member 140 interacts with first member 120 so that the rotation device 150 is driven to be rotated.

Figure 3:
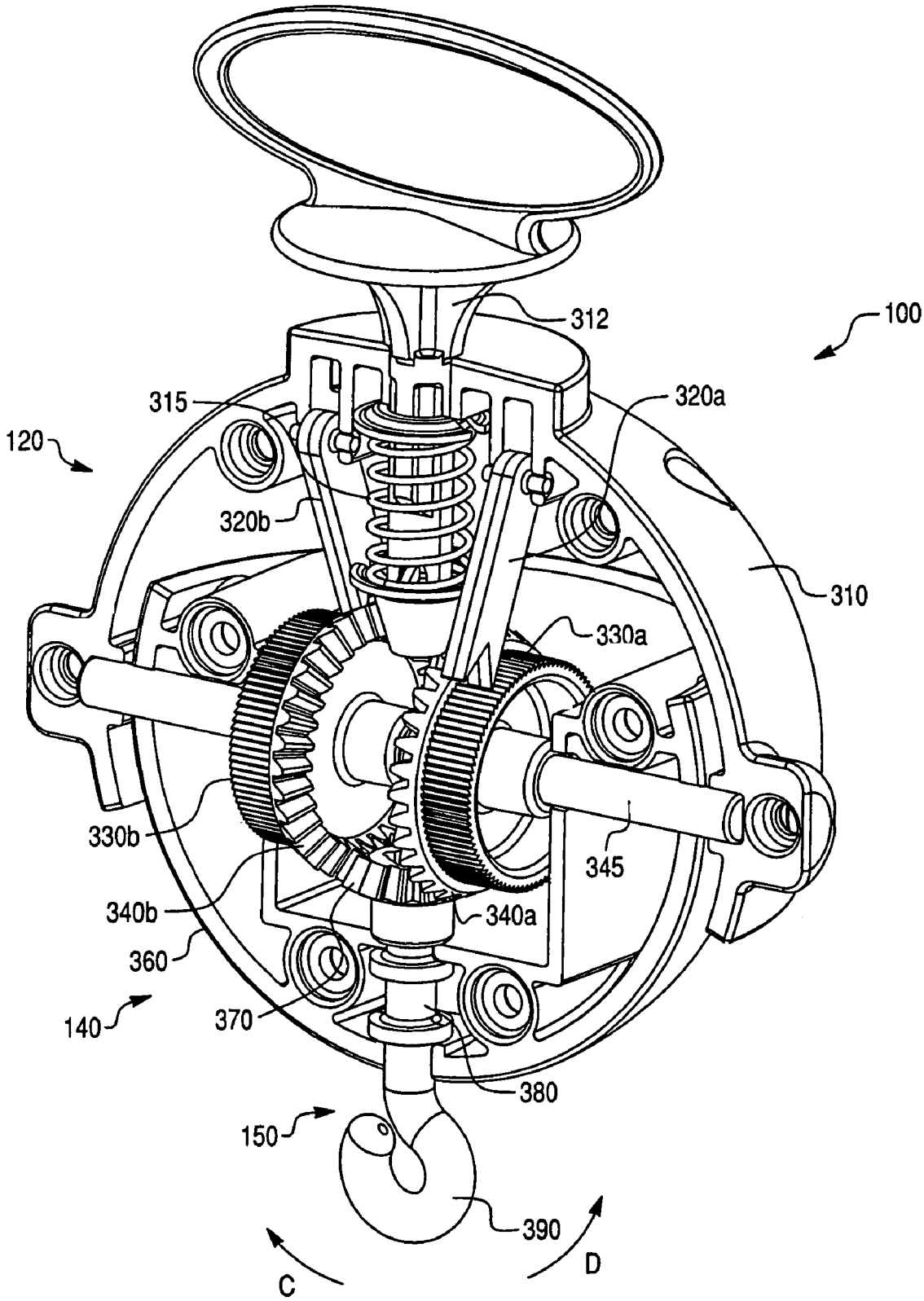
FIG. 3 is a perspective cutaway view of a motion conversion mechanism according to an embodiment of the invention.
Figure 4:
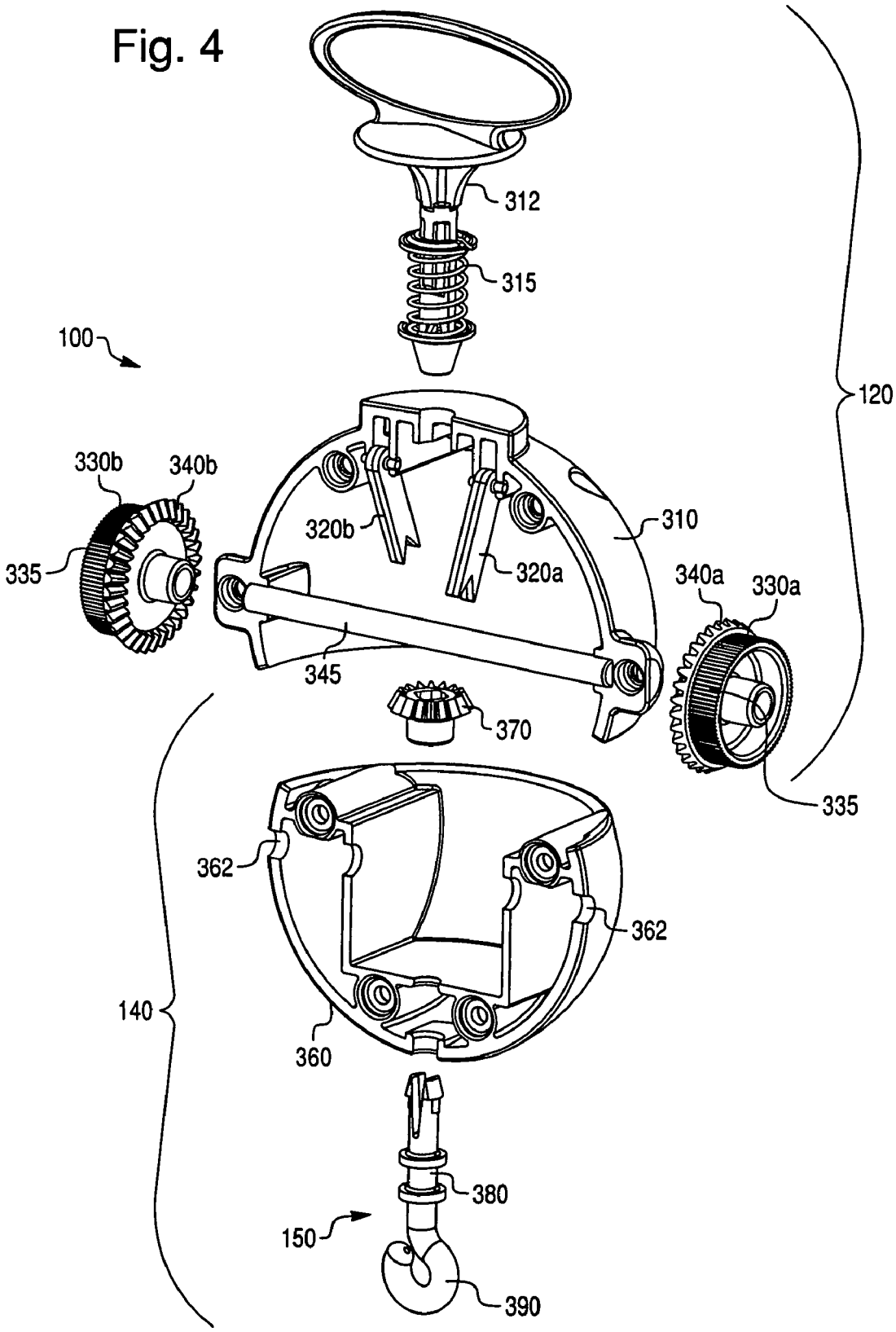
FIG. 4 is an exploded view of the motion conversion mechanism of the embodiment of FIG. 3 illustrating components of the motion conversion mechanism.
Figure 5:
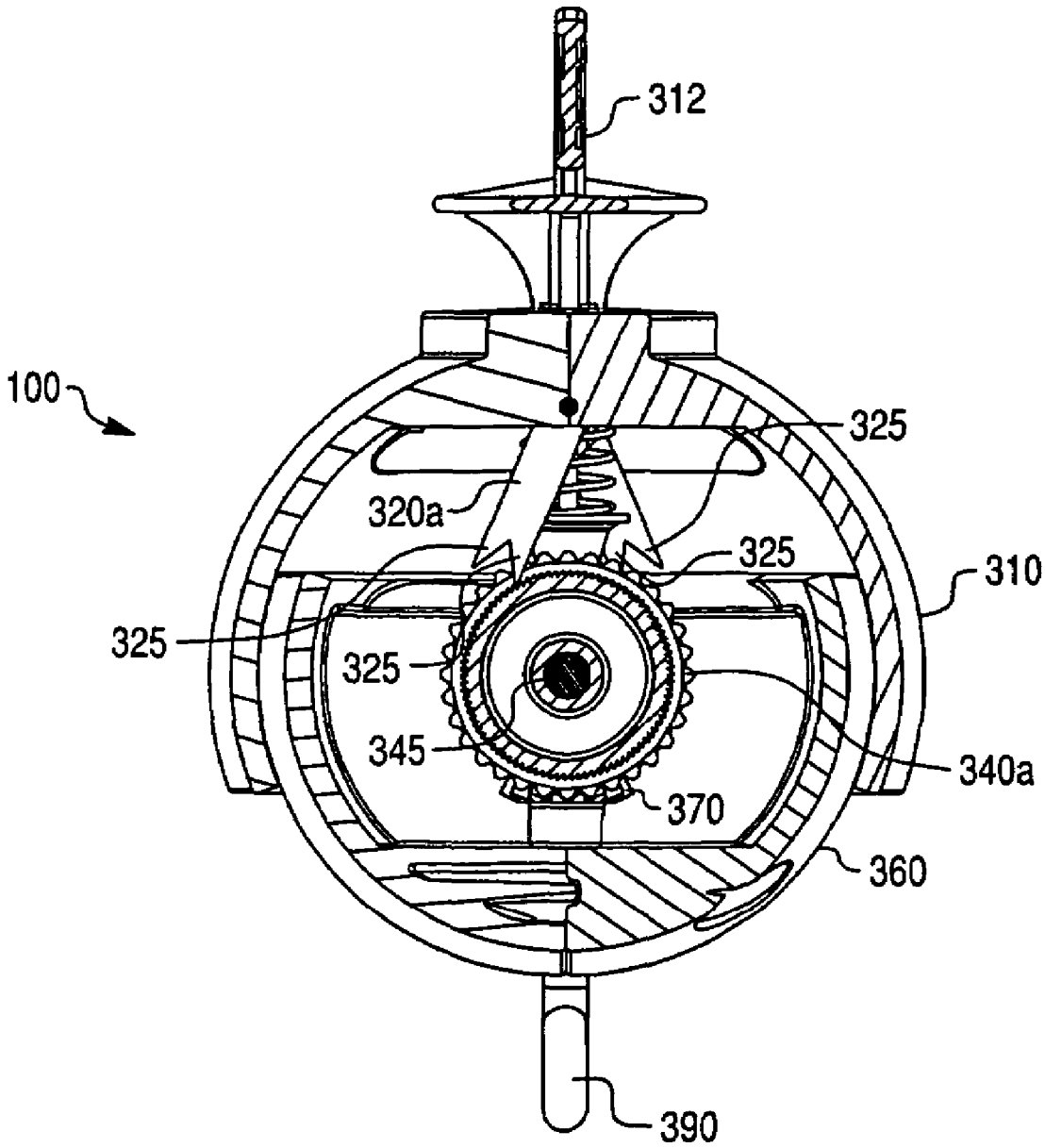
FIG. 5 is a side cutaway view of the motion conversion mechanism of the embodiment of FIG. 3.

FIGS. 3-5 illustrate an embodiment of the motion conversion mechanism 100. In this embodiment the first member 120 comprises a first member housing 310, pawls 320*a* and 320*b*, ratchets 330*a* and 330*b*, gears 340*a* and 340*b*, and axle 345. The second member 140 comprises a second member housing 360 and second member gear 370. The rotation device 150 of the second member 140 comprises a rotation axle 380 and hook 390. The hook 390 is configured to attach to a toy, for example, such as a mobile with decorative objects (See FIG. 1).

The first member housing 310 can be attached to a support via an attachment mechanism 312 so that the angular motion of the support is imparted to the first member housing 310 during motion of the support.

The gears 340*a*, 340*b* are coupled to the respective ratchets 330*a*, 330*b* and engage with the second member gear 370. The gears 340*a*, 340*b* may be integral with the respective ratchets 330*a*, 330*b*, for example as shown in FIGS. 3 and 4, or may be separate. The gears 340*a*, 340*b* and the second member gear 370 may be bevel gears, crown gears or spur gears, for example. The bevel gears may be coarse tooth bevel gears, as shown in FIGS. 3 and 4.

The gear ratio between the second member gear 370 and the gears 340*a*, 340*b* controls the angular speed of the rotation device 150, which is, in Figures and 4, the rotation axle 380. The angular speed of the rotation device 150 will be the angular speed of the gears 340*a*, 340*b* times the gear ratio. Thus, the angular speed of the rotation device 150 can be controlled by selecting an appropriate gear ratio. The gear ratio may be 2:1, for example, or some other value.

Both the gears 340*a*, 340*b* and the ratchets 330*a*, 330*b* are rotationally coupled to the axle 345 so that they may rotate about the axle 345 when such rotation is not prevented by the pawls 320*a*, 320*b*. In turn, the axle 345 is fixed to the first member housing 310.

The pawls 320*a*, 320*b* are attached to the first member housing 310, such as by being rotationally coupled to the first member housing 310, or such that the pawls 320*a*, 320*b* flex relative to the first member housing 310. The pawls 320*a*, 320*b* engage with the respective ratchets 330*a*, 330*b* by contacting teeth 335 of the ratchets 330*a* and 330*b*. The pawls 320*a*, 320*b* may have two symmetrical teeth 325 to engage contacting teeth 335 of the ratchets 330*a* and 330*b* as shown in FIGS. 3-5 to aid in preventing the pawls 320*a*, 320*b* from being installed so that the pawls 320*a*, 320*b* do not properly engage the ratchets 330*a* and 330*b*. Alternatively, the pawls 320*a*, 320*b* may each have a single tooth. The pawls 320*a*, 320*b* may be spring loaded pawls, or ratcheting pawls that rely on gravity, for example. The teeth 335 of the ratchets 330*a* and 330*b* may be chosen to be sufficiently fine to produce motion even when the change in the angular displacement between the first member 120 and the second member 140 is small.

Each ratchet and pawl combination, 330*a* and 320*a* or 330*b* and 320*b*, is arranged such that in one rotation direction of the ratchet, the pawl engages the ratchet to prevent rotation of the ratchet, while in the opposite rotation direction, the pawl ratchets over the ratchet and allows rotation. Preferably, the gears 340*a*, 340*b* and second member gear 370 and ratchet and pawl combinations are arranged such that for angular displacement of the second member gear 370 in one direction about the axle 345 (direction C or D in FIG. 3), the pawl 320*a* prevents rotation of the ratchet 330*a* and the pawl 320*b* allows rotation of the ratchet 330*b*, while for the opposite displacement direction of the second member gear 370 about the axle 345 (the other of direction C or D in FIG. 3), the pawl 320*a* allows rotation of the ratchet 330*a* and the pawl 320*b* prevents rotation of the ratchet 330*b*. As explained further below, this arrangement allows the rotation conversion mechanism 100 to convert angular motion to rotational motion of the rotation device 150 both when the first member 120 moves in a first angular direction and in a second angular direction opposite to the first, and thus converts angular motion to rotational motion in a continuous fashion.

The second member housing 360 is pivotably connected to the first member housing 310. For example, the second member housing 360 may have through holes 362 through which passes the axle 345 of the first member 120 passes. In this case the second member housing 360 pivots about the axle 345. Thus, the second member housing 360, and the second member 140 in general, may change its angular orientation relative to the first member 120.

As the support (not shown in FIGS. 3 and 4) moves back and forth in the first angular direction and then the second angular direction, the second member 140 pivots relative to the first member 120 about the axle 345 due to gravitational force so that the rotation axle 380 remains directed toward the ground.

As the rotation axle 380 orients itself toward the ground under the influence of gravitational force, the second member gear 370 is pushed against the gears 340*a* and 340*b*, and exerts a rotational force on the gears 340*a* and 340*b* that would tend to rotate the gears 340*a* and 340*b* about the axle 345 in opposite directions. As mentioned above, the gears and the ratchet and pawl combinations are preferably arranged such that, for angular displacement of the second member gear 370 in one direction about the axle 345 (direction C or D in FIG. 3), the pawl 320*a* prevents rotation of the ratchet 330*a* and the pawl 320*b* allows rotation of the ratchet 330*b*, while for the opposite angular displacement direction of the second member gear 370 about the axle 345, the pawl 320*a* allows rotation of the ratchet 330*a* and the pawl 320*b* prevents rotation of the ratchet 330*b*. Thus, when the second member gear 370 exerts a rotational force on the gears 340*a* and 340*b* as the rotation axle 380 orients itself toward the ground, there will always be one of the ratchet pawl combinations arranged such that the pawl prevents the ratchet from rotating. The gear 340*a* or 340*b* corresponding to the fixed ratchet 330*a* or 330*b* will then exert a counter rotational force on the second member gear 370 causing it to rotate, which in turns exerts a rotational force on the rotation device 150 (rotation axle 380 and hook 390) causing it to rotate.

Further, because there is always one of the ratchet pawl combinations where the ratchet will be fixed, the rotation conversion mechanism 100 converts the angular motion associated with the first member 120 into rotational motion of rotation device 150 both when the angular motion of the first member 120 is in the first angular direction and when the angular motion of the first member 120 is in the second angular direction opposite to the first. In other words, there will always be one of the gears, 340*a* or 340*b*, that acts to impart a rotational force on the second member gear 370 to drive the rotation of the rotational device 150 regardless of whether the first member 120 is moving in the first angular direction or in the second angular direction. In this way, conversion of the angular motion to rotational motion of the rotation device 150 is continuous.

The rotation axis 152 (See FIG. 2) of the rotation device 150 need not be parallel to the angular motion axis 52 of the motion of the support 50. Thus, the rotation conversion mechanism 100 may convert angular motion about the angular motion axis to rotational motion about a rotation axis that is not parallel to the angular motion axis. For example, the rotation axis 152 of the rotation device 150 points in a vertical direction, and would be perpendicular to the angular motion axis, which is in a horizontal direction, in the case that the rotation conversion mechanism 100 is mounted to a swing in the fashion shown in FIG. 1.

The rotation mechanism 100 may be rotated about a vertical axis to adjust the rotation speed of the rotation device 150. The rotation speed will be greatest when the axle 345 is parallel to the angular motion axis and least when the axle 345 is rotated in the same plane of the angular motion axis to be perpendicular to the angular motion axis. In this regard, the attachment mechanism 312 may be rotated relative to the first member housing 310 to adjust the direction of the axle 345. The spring 315 of the attachment mechanism 312 keeps the first member housing 310 coupled to the attachment mechanism 312, while still allowing for rotation of the attachment mechanism 312 relative to the first member housing 310.

As an alternative, the ratchet and pawl combinations may be arranged such that for one rotational direction of the second member gear 370, the pawls 320*a* and 320*b* each prevent rotation of the respective ratchets 330*a* and 330*b*, while for the opposite rotational direction, the pawls 320*a* and 320*b* each allow rotation of the ratchets 330*a* and 330*b*. In this case, the motion conversion mechanism 100 will convert the angular motion associated with the first member 120 into rotational motion of rotation device 150 only when the angular motion of the first member 120 is one of the first and second directions, but not for both the first and second directions.

As another alternative, the motion conversion mechanism 100 may include only a single pawl, ratchet and gear coupled to the ratchet. In this case also, the motion conversion mechanism 100 will convert the angular motion associated with the first member 120 into rotational motion of rotation device 150 only when the angular motion of the first member 120 is one of the first and second directions, but not for both the first and second directions.

Figure 6A:
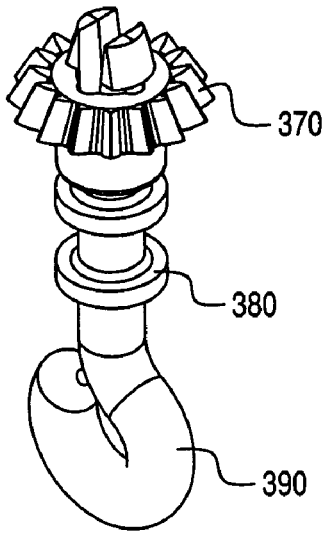
FIGS. 6A and 6B are a perspective view and an exploded view, respectively, illustrating a clutch mechanism of the embodiment of FIG. 3.
Figure 6B:
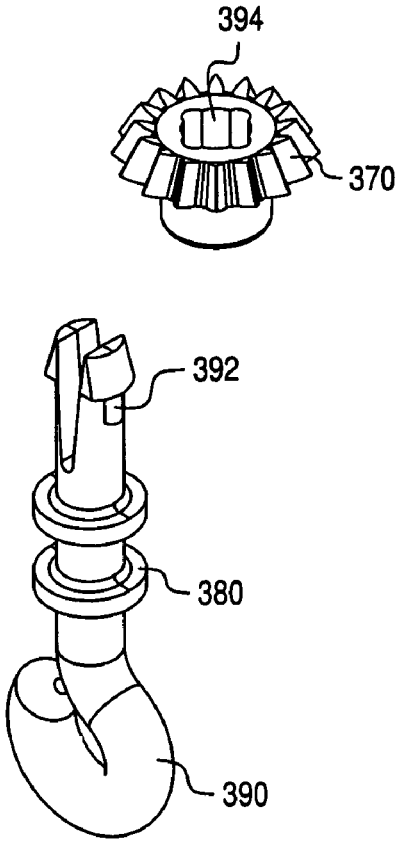

The rotation conversion mechanism 100 may also include a torque limiting clutch as best seen in FIGS. 6A and 6B. In the embodiment of FIGS. 3-5, the rotation device 150 will be driven in one rotation direction both when the angular motion of the first member 120 is in a first direction and in an opposite second direction. The clutch is associated with the rotation device 150 and the second member gear 370 such that excessive torque applied to the rotation device 150 is not transferred to the second member gear 370. In this way the clutch prevents the internal mechanism of the rotation conversion mechanism 100 from being damaged if the rotation device 150 is rotated in a direction opposite to the driven direction. The clutch may include raised portions 392 near the end of the rotation device 150 and a receiving aperture 394 on an inside surface of the second member gear 370. When the raised portions 392 engage with smaller diameter portions of the receiving aperture 394, there is resistance to rotation of the rotation device 150 relative to the second member gear 370. This resistance may be overcome, however, by increasing torque on the rotation device 150.

Figure 7:
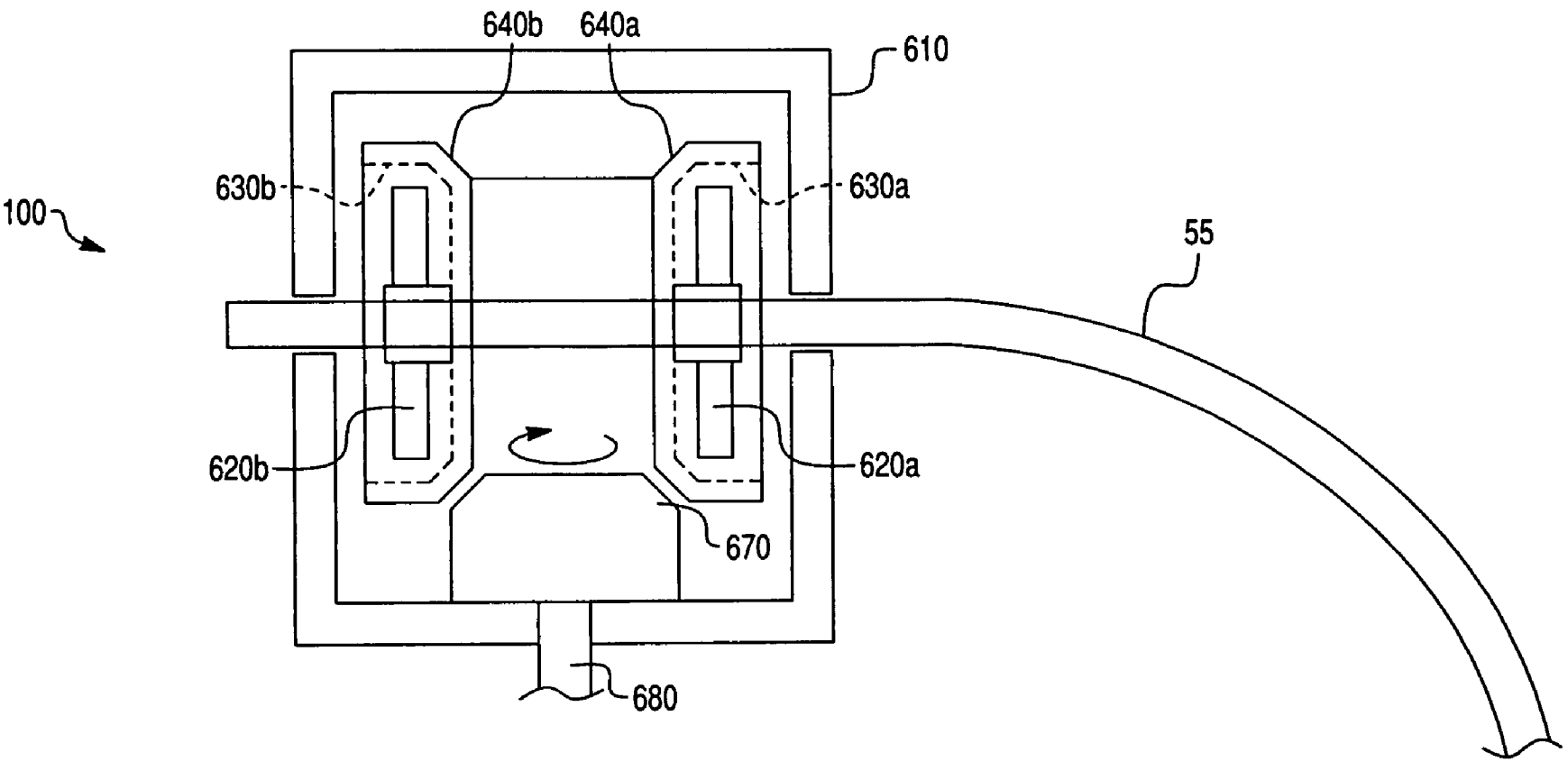
FIG. 7 is front cutaway view of a motion conversion mechanism according to another embodiment of the invention.
Figure 8:
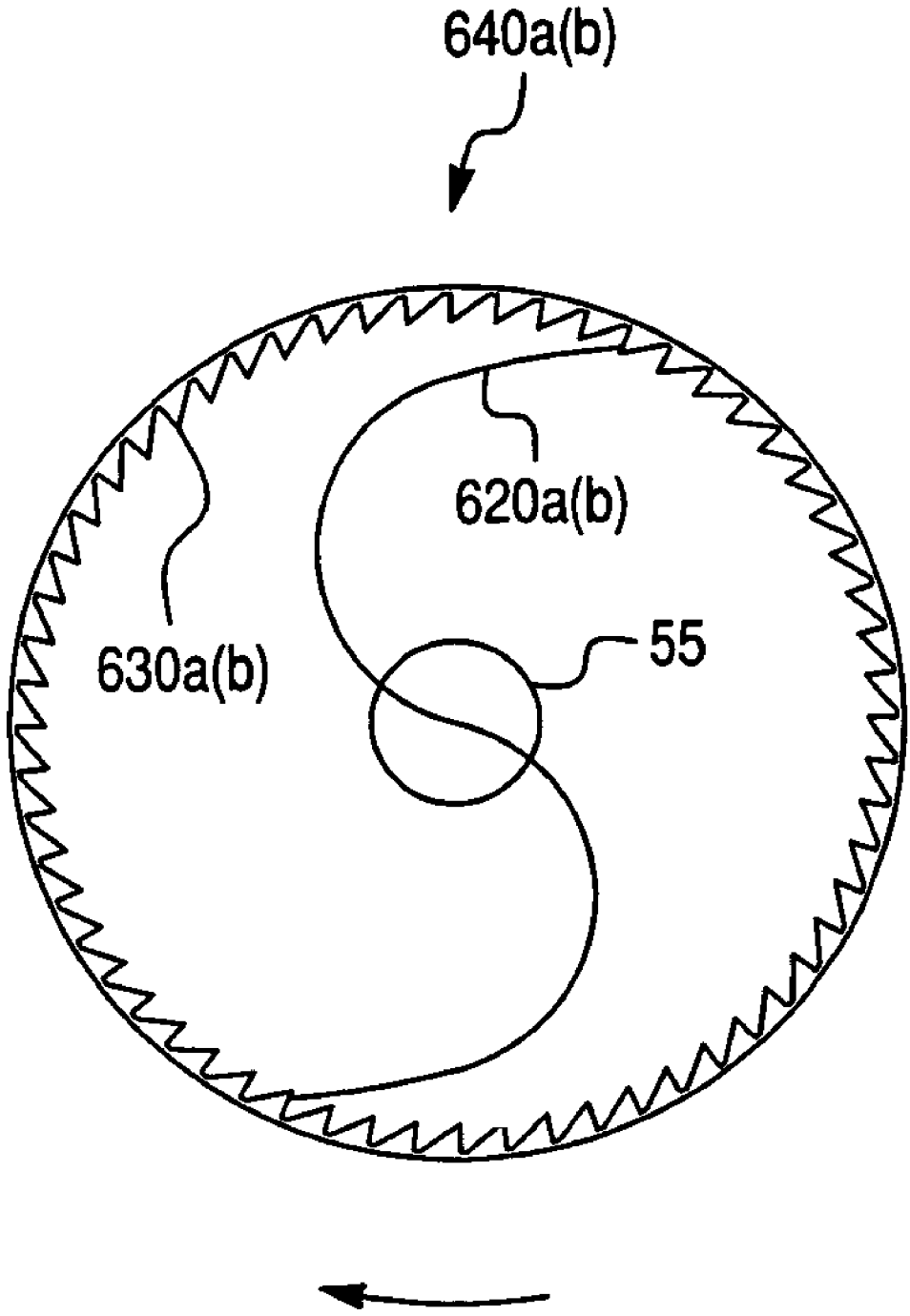
FIG. 8 is a side view of a ratchet and pawl of the motion conversion mechanism of the embodiment of FIG. 7.

FIGS. 7 and 8 illustrate another embodiment of a embodiment of the motion conversion mechanism 100. FIG. 7 illustrates the motion conversion member 100 attached to a support 55. In this embodiment, the first member 120 comprises a first member housing 610, pawls 620*a* and 620*b*, ratchets 630*a* and 630*b*, and gears 640*a* and 640*b*. The second member 140 comprises a second member gear 670. The rotation device 150 of the second member 140 comprises a rotation axle 680.

The first member housing 610 in this embodiment is configured to be rotationally coupled to the support 55, while the pawls 620*a* and 620*b* are configured to be fixedly attached to the support 55. In this embodiment, the pawls 620*a* and 620*b* each comprise a curved spring finger that may engage with one of the teeth of its respective ratchet 630*a* and 630*b*. The pawls 620*a* and 620*b* are arranged within their respective ratchets 630*a* and 630*b*, as shown in FIG. 8. The ratchets 630*a* and 630*b* are arranged within their respective gears 640*a* and 640*b*, as shown in FIG. 7. The gears 640*a* and 640*b* engage with the second member gear 670 to cause rotation thereto.

In a similar fashion to the embodiment of FIGS. 3-5, in this embodiment the gears and ratchet and pawl combinations can be arranged such that, for one angular displacement direction of the second member gear 670, the pawl 620*a* prevents rotation of the ratchet 630*a* and the pawl 620*b* allows rotation of the ratchet 630*b*, while for the opposite angular displacement direction of the second member gear 670, the pawl 620*a* allows rotation of the ratchet 630*a* and the pawl 620*b* prevents rotation of the ratchet 630*b*. In a similar fashion to the embodiment of FIGS. 3-5, for such an arrangement the rotation conversion mechanism 110 converts the angular motion associated with the first member 120 into rotational motion of rotation device 150 both when the angular motion of the first member 120 is in a first direction and when the angular motion of the first member 120 is in a second direction opposite to the first. In this regard FIG. 7 illustrates one of the pawls 620*a* or 620*b*. The other of the pawls 620*b* or 620*a* is a mirror image of the one pawl.

Alternatively, the gear and ratchet and pawl combinations may be arranged such that for one rotational direction of the second member gear 670, the pawls 620*a* and 620*b* each prevent rotation of the respective ratchets 630*a* and 630*b*, while for the opposite rotational direction the pawls 620*a* and 620*b* each allow rotation of the ratchets 630*a* and 630*b*. As another alternative, the motion conversion mechanism 100 of FIGS. 7 and 8 may include only a single pawl, ratchet and gear coupled to the ratchet.

Figure 9:
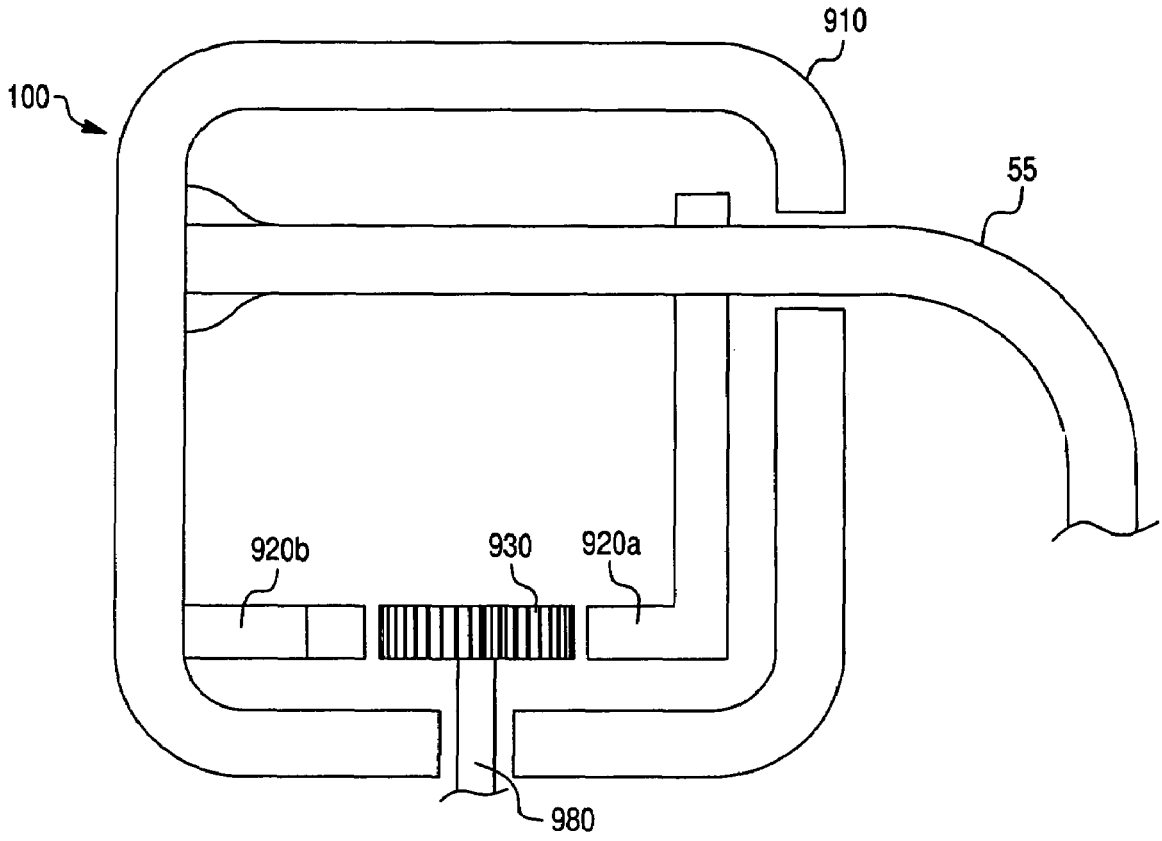
FIG. 9 is a front cutaway view of a motion conversion mechanism according to another embodiment of the invention.
Figure 10:
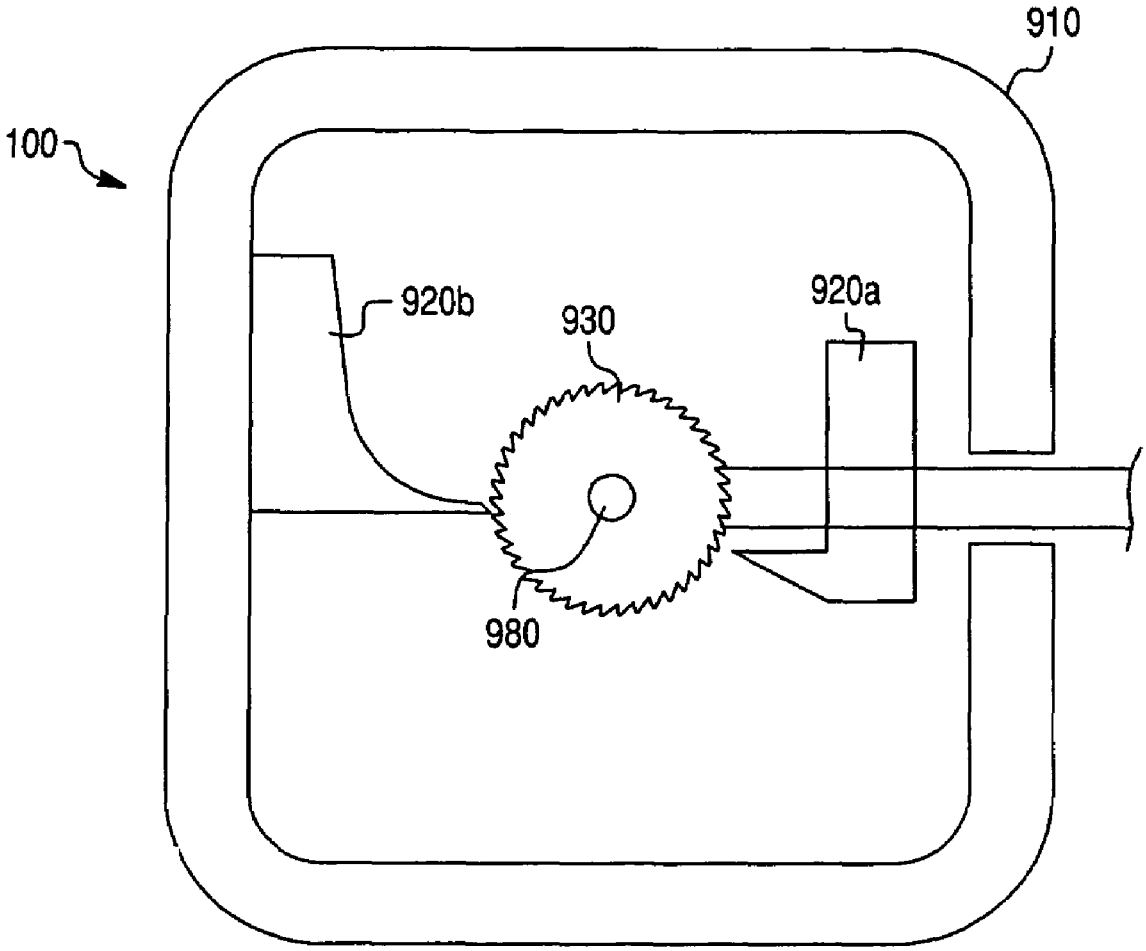
FIG. 10 is a top cutaway view of the motion conversion mechanism of the embodiment of FIG. 9.

FIGS. 9 and 10 illustrate another embodiment of the motion conversion mechanism 100. FIG. 9 illustrates the motion conversion member 100 attached to a support 55. In this embodiment, the first member 120 comprises a first member housing 910 and pawls 920*a* and 920*b*. The second member 140 comprises ratchet 930 and the rotation device 150, which comprises a rotation axle 980.

The first member housing 910 in this embodiment is configured to be rotationally coupled to the support 55. The pawl 920*b* is configured to be attached to the support 55, while the pawl 920*a* is attached to the first member housing 910. The rotation axis of the ratchet 930 is coincident with the rotation axis of the rotation device 150.

In this embodiment, preferably the pawls 920*a* and 920*b* can be arranged relative to the ratchet 930 such that pawl 920*a* prevents rotation of the ratchet 930 for rotation in one direction, while for the opposite rotational direction the pawl 920*b* prevents rotation of the ratchet 930. The rotation conversion mechanism 100 in this embodiment converts the angular motion associated with the first member 120 into rotational motion of rotation device 150 only when the angular motion of the first member 120 is in a first direction or when the angular motion of the first member 120 is in a second direction opposite to the first, but not for both directions.

Alternatively, the pawls 920*a* and 920*b* may be arranged relative to the ratchet 930 such that both pawls 920*a* and 920*b* prevent rotation of the ratchet 930 for rotation in one direction, while for the opposite rotational direction both pawls 920*a* and 920*b* allow rotation of the ratchet 930. As another alternative, the motion conversion mechanism 100 of FIGS. 9 and 10 may include only a single pawl and ratchet coupled to the ratchet.

Figure 11:
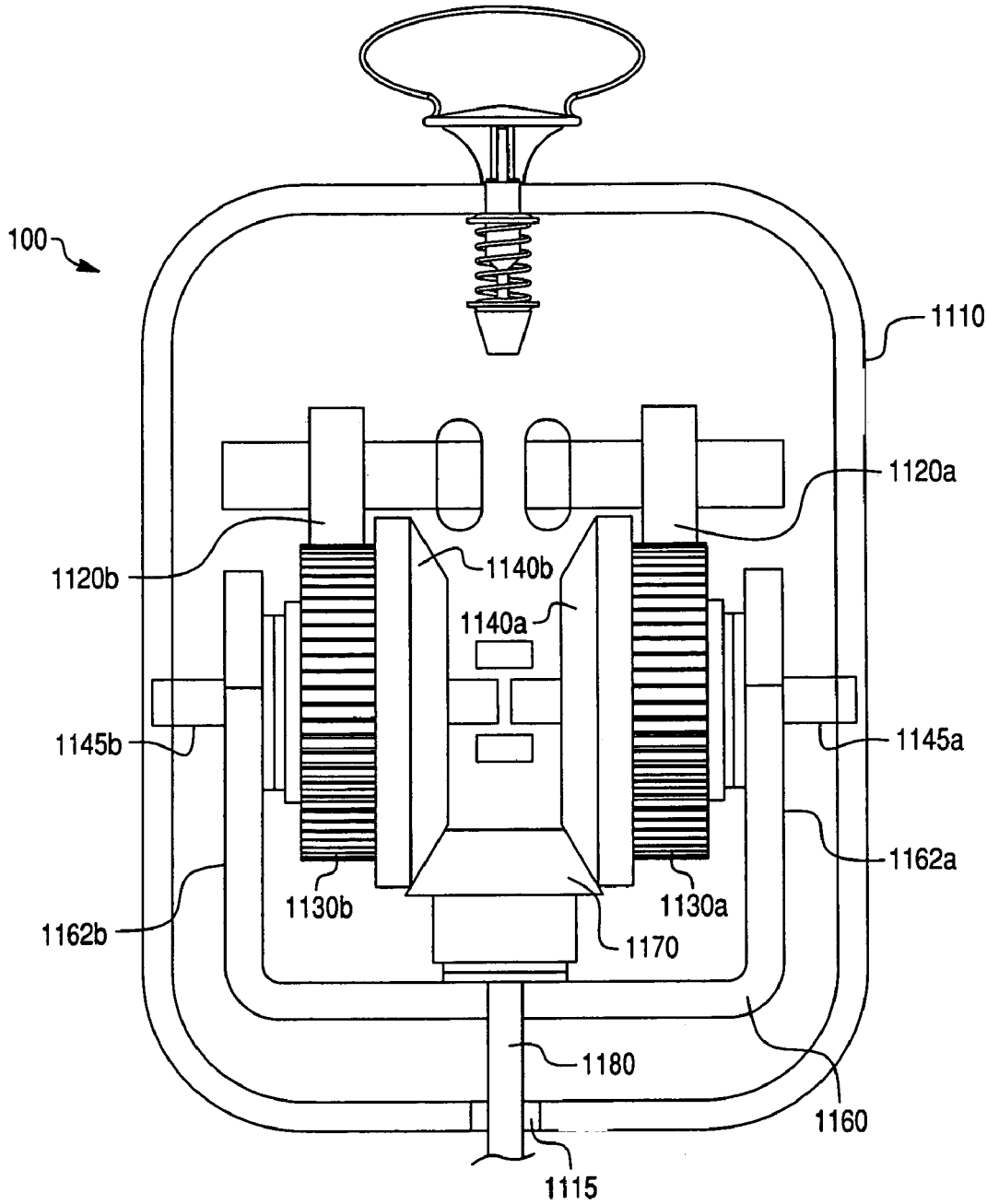
FIG. 11 is a front cutaway view of a motion conversion mechanism according to another embodiment of the invention.
Figure 12:
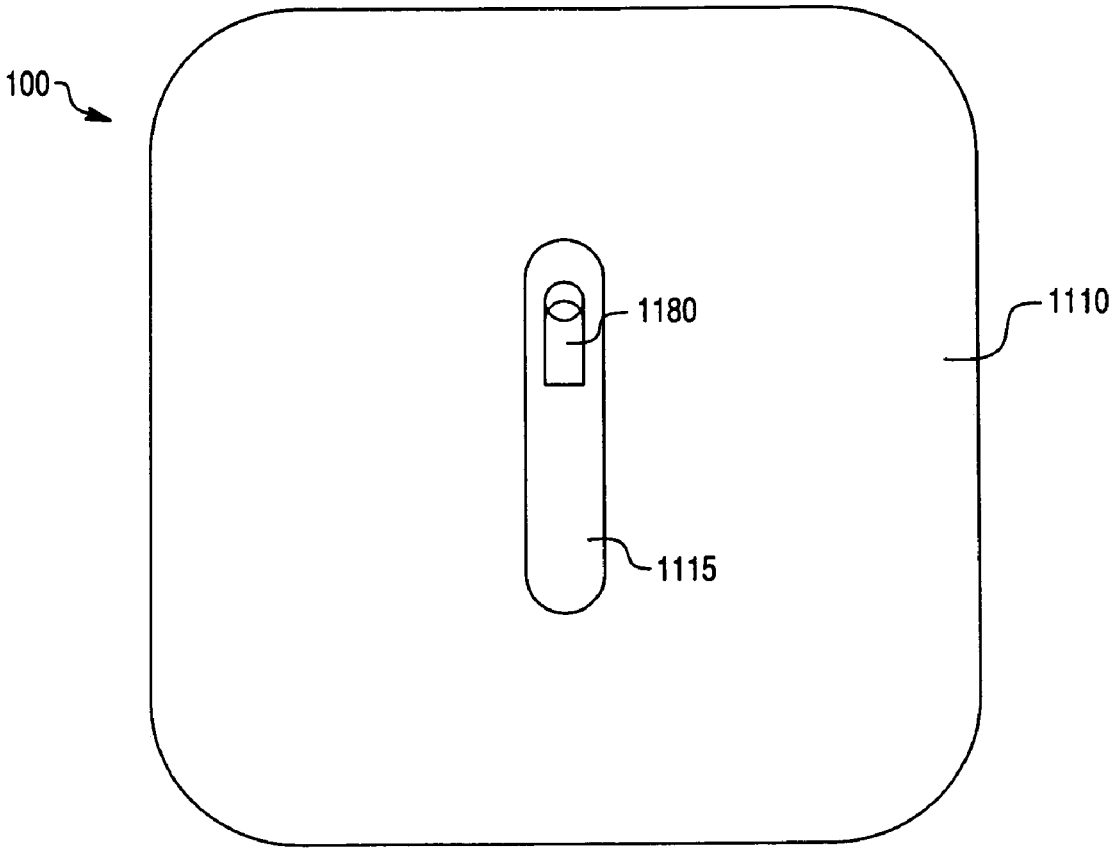
FIG. 12 is a bottom view of the motion conversion mechanism of the embodiment of FIG. 11.

FIGS. 11 and 12 illustrate another embodiment similar to the embodiment of FIGS. 3-5, but where there is a single housing 1110 instead of a first member housing and a second member housing. In this embodiment, the first member 120 comprises a housing 1110, pawls 1120*a* and 1120*b*, ratchets 1130*a* and 1130*b*, gears 1140*a* and 1140*b*, and axles 1145*a* and 1145*b*. The second member 140 comprises a second member support 1160 and second member gear 1170. The rotation device 150 of the second member 140 comprises a rotation axle 1180. The second member support 1160 is enveloped by the housing 1110.

The housing 1110 has a slot 1115 through which the rotation axle 1180 extends. The rotation axle 1180 can slide relative to the slot 1115 as the support moves along the first angular direction and the second angular direction. The ratchets 1130*a* and 1130*b* and gears 1140*a* and 1140*b* are rotationally coupled to the axles 1145*a* and 1145*b*, respectively. The second member support 1160 has arms 1162*a* and 1162*b* that are rotationally coupled to the axles 1145*a* and 1145*b*, respectively. The second member support 1160 supports the second member gear 1170 and rotation axle 1180, and allows the second member gear 1170 and rotation axle 1180 to rotate relative to the second member support 1160. The embodiments of FIGS. 6-10 may also include a slot in similar fashion to this embodiment.

Figure 13:
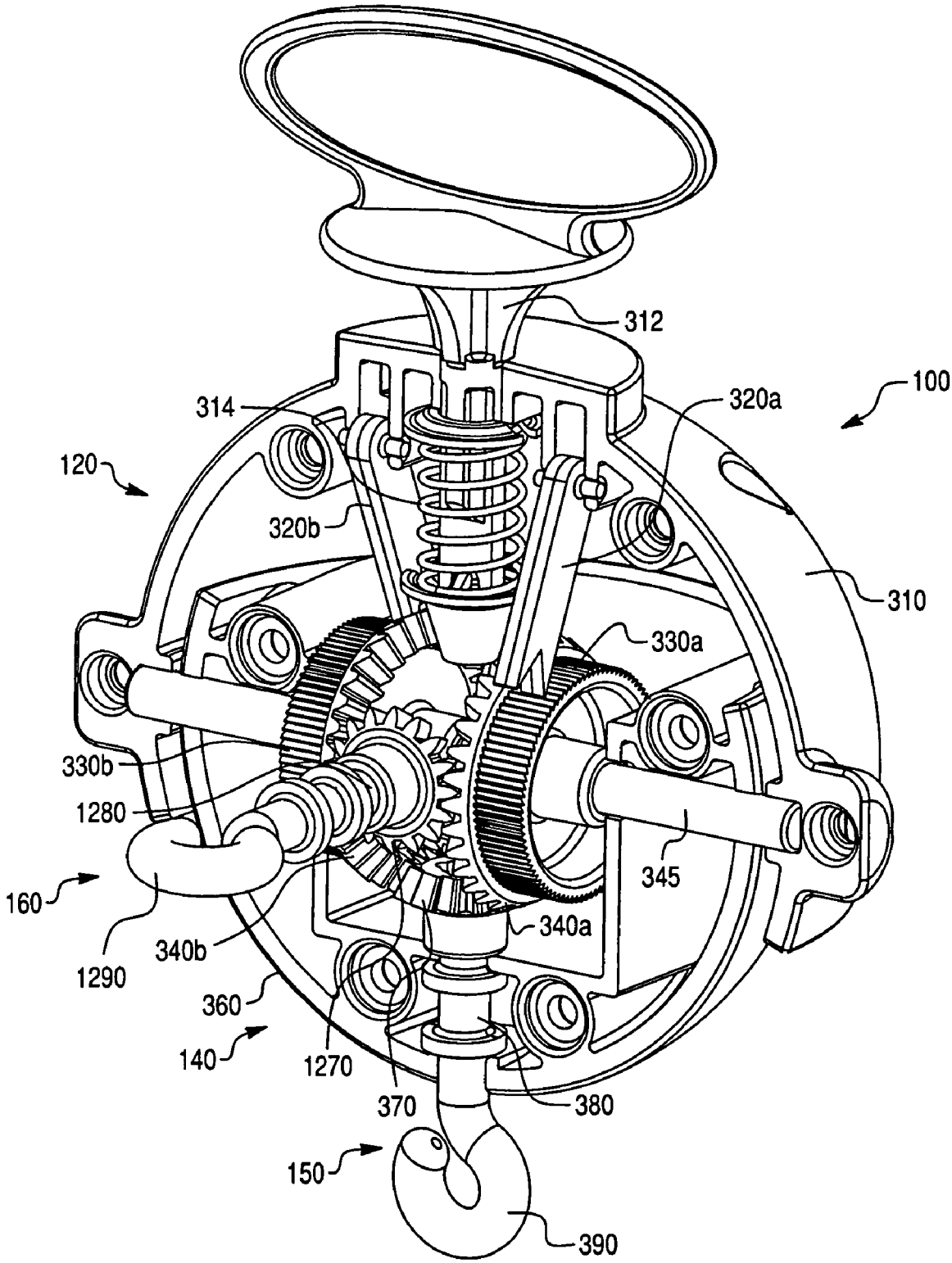
FIG. 13 is a perspective cutaway view of a motion conversion mechanism according to another embodiment of the invention.
Figure 14:
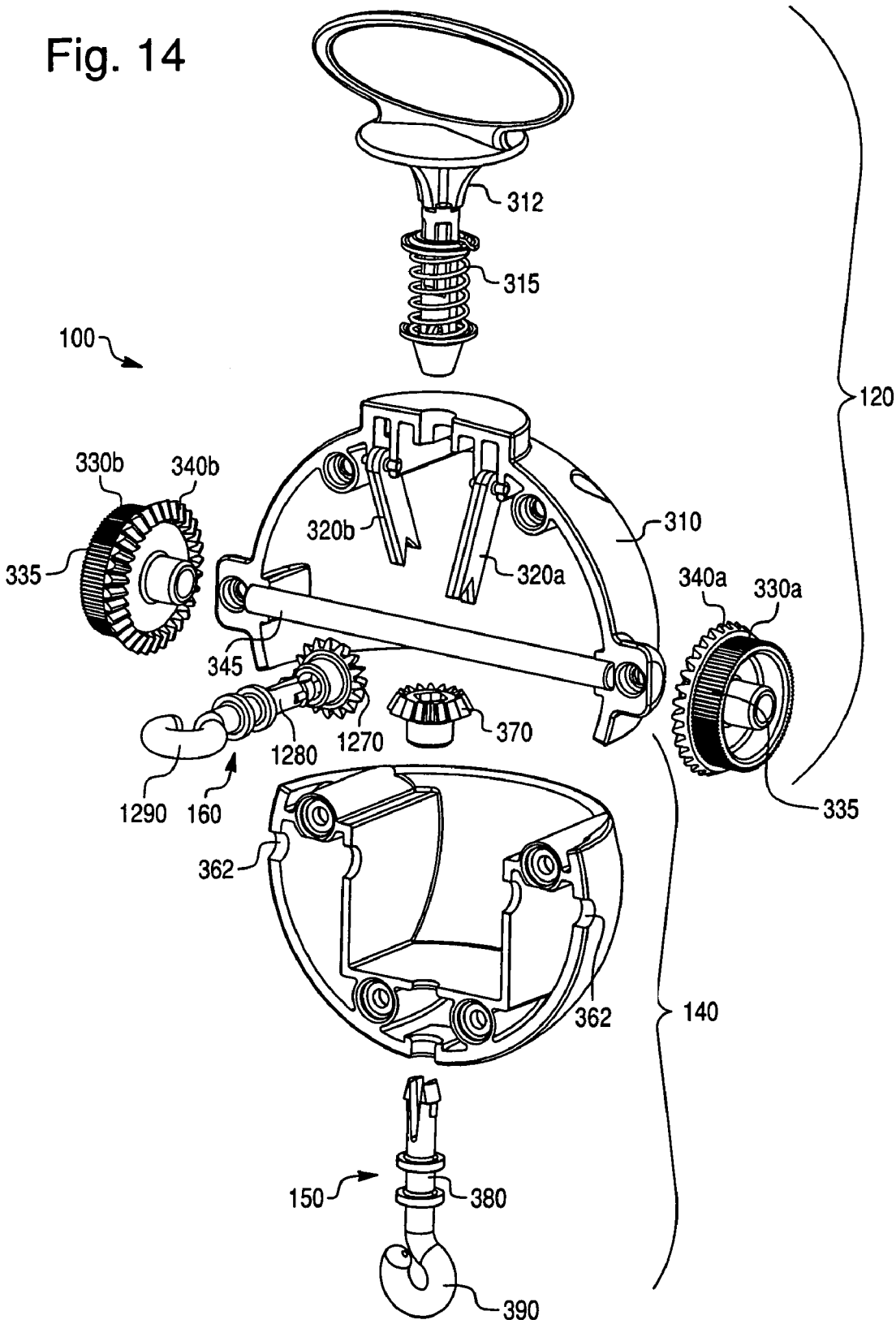
FIG. 14 is an exploded view of the motion conversion mechanism of the embodiment of FIG. 13 illustrating components of the motion conversion mechanism.
Figure 15:
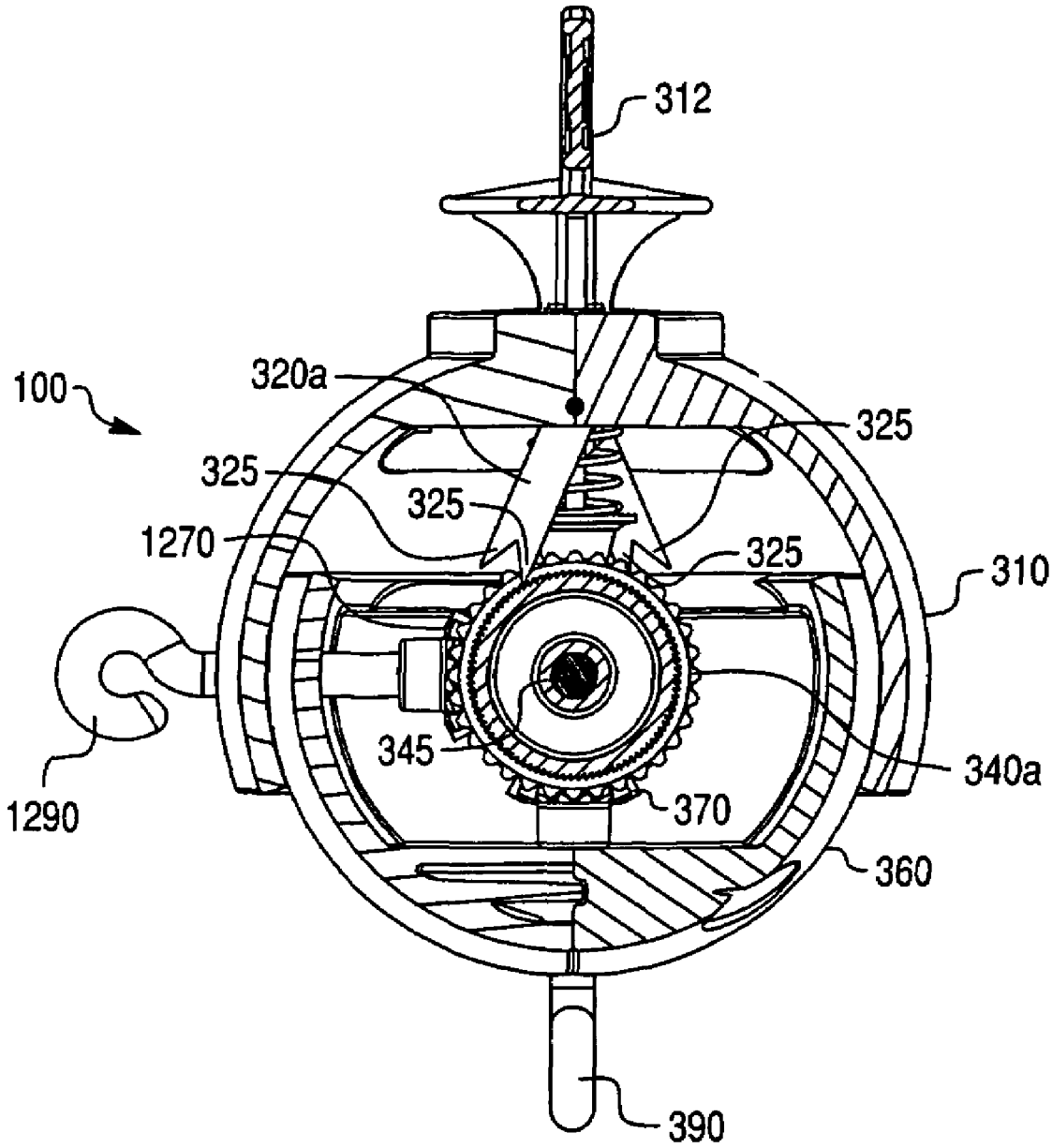
FIG. 15 is a side cutaway view of the motion conversion mechanism of the embodiment of FIG. 13.

FIGS. 13-15 illustrate another embodiment of the motion conversion mechanism 100. This embodiment is similar to the embodiment of FIGS. 3-5, but includes an auxiliary rotation device 160. Similar components in the embodiments of this embodiment and the embodiment of FIGS. 3-5 are indicated by like reference numerals. In this embodiment the rotation device 150 acts as a primary rotation device.

The auxiliary rotation device 160 includes an auxiliary rotation axle 1280 and an auxiliary hook 1290. The auxiliary hook 1290 is configured to attach to a toy, for example.

The motion conversion mechanism 100 in this embodiment includes an auxiliary gear 1270 that engages with the gears 340*a* and 340*b*. The rotation of the gears 340*a* and 340*b* drive the rotation of the auxiliary gear 1270. In turn, the rotation of the auxiliary gear 1270 drives the rotation of the auxiliary rotation device 160, which is attached to the auxiliary gear 1270.

When the angular motion of the first member 120 is converted to the rotational motion of the primary rotation device (rotation device 150 including rotation axle 380 and an hook 390), the gears 340*a* and 340*b* are driven to rotate, which in turn drive the auxiliary gear 1270 and cause the auxiliary rotation device 160 to rotate. As shown in FIGS. 13-15, the rotation axis of the auxiliary rotation device 160 is different from the rotation axis of the primary rotation device (rotation device 150). For example, the rotation axis of the auxiliary rotation device 160 may be perpendicular to the rotation axis of the primary rotation device. In addition, rotation axis of the auxiliary rotation device 160 may be parallel to the angular motion axis of the first member 120, or may be at an angle, such as perpendicular to, the angular motion axis of the first member 120.

All of the embodiments of FIGS. 7-15 may include a clutch in a similar fashion to the embodiment of FIGS. 3-5. The embodiment of FIGS. 13-15 may include a clutch both for the auxiliary rotation device and the primary rotation device.

The housings of the above embodiments of the motion conversion mechanism 100 may be made of a transparent or translucent material, if desired, so that the inner workings of the motion conversion mechanism 100 may be viewed by a user.

The embodiments above have been described with respect to child containment structure that is a swing. The motion conversion mechanism 100, however, is applicable to a number of other applications of a child containment structure where a support of the structure and the first member 120 can undergo motion in a first angular direction and a second angular direction about an angular motion axis to provide play value to a child in the child entertainment apparatus 5.

As explained above, the motion conversion mechanism 100 can be employed with any child containment structure that undergoes angular motion, such as a swing 10, to convert the angular motion of the child containment structure to motion of a toy coupled to the motion conversion mechanism 100. The motion conversion mechanism 100 can be attached directly to the child containment structure, in which case the child containment structure itself provides a support for the motion conversion mechanism 100. Alternatively, the motion conversion mechanism 100 can be attached to a support that extends between the child containment structure and the motion conversion mechanism 100. The motion conversion mechanism 100 can convert motion both when the child containment structure moves in a first angular direction, for example, forward swinging motion of a child swing, and in a second opposite angular direction, for example, rearward swinging motion of a child swing. Possible child containment structures of this type can include a swing, bouncer, a rocking bassinet, a rocking chair, and a rockable infant carrier (usually associated with a child vehicle seat).

The motion conversion mechanism 100 also can be attached to a fixed child containment structure, such as a crib, via a support that moves relative to the fixed child containment structure so that angular motion of the support can be converted to motion of a toy coupled to the motion conversion mechanism 100. Possible child containment structures of this type can include cribs, play yards, convertible and forward facing child car seats, high chairs, booster seats, and strollers.

Further, where the child containment structure may comprise a bassinet with a child support surface to support a child, or a rocking chair with a rocking chair seat as a child support surface. In both these applications the rocking motion, which may impart angular motion to the first member such that the angular motion axis is not fixed, could be converted into angular rotation motion using the motion conversion mechanism as described above.

In another example, the child containment structure could be a play yard with an angularly oscillating member attached. The motion conversion mechanism could be attached to the angularly oscillating member. In this case the child support surface of the play yard would not move in angular motion.

The preferred embodiments have been set forth herein for the purpose of illustration. This description, however, should not be deemed to be a limitation on the scope of the invention. Various modifications, adaptations, and alternatives may occur to one skilled in the art without departing from the claimed inventive concept. The true scope and spirit of the invention are indicated by the following claims.

What is claimed is:

1. A motion conversion mechanism for use with a child containment structure, the motion conversion mechanism comprising:

a first member configured to be arranged relative to the child containment structure to undergo motion in a first angular direction and in a second angular direction opposite to the first angular direction;

a second member attached to a rotation device that is rotatable about a rotation axis; and a first gear member in communication with the first member, and a second gear member in communication with the second member, wherein the first and second gear members intermesh to convert the angular motion of the first member to rotation of the rotation device, wherein the rotation device is driven to rotate when the first member moves both in the first angular direction and in the second angular direction.

2. The motion conversion mechanism of claim 1, wherein the motion in the first angular direction and in the second angular direction is about an angular motion axis, and the rotation axis is not parallel to the angular motion axis.

3. The motion conversion mechanism of claim 2, wherein the angular motion axis is fixed.

4. The motion conversion mechanism of claim 2, wherein the angular motion axis is not fixed.

5. The motion conversion mechanism of claim 1, wherein the first member is configured to be directly attached to the child containment structure.

6. The motion conversion mechanism of claim 1, wherein the first member is configured to be indirectly attached to the child containment structure via a support arm.

7. The motion conversion mechanism of claim 1, further comprising a toy attached to the rotation device.

8. The motion conversion mechanism of claim 1, wherein the rotation axis is substantially perpendicular to the angular motion axis.

9. The motion conversion mechanism of claim 1, wherein the first member comprises:

a first member housing configured to be attached to a support of the child containment structure;

at least one pawl; and at least one ratchet configured to engage with the at least one pawl.

10. The motion conversion mechanism of claim 9, wherein the first member housing is configured to be fixedly attached to the support, and the at least one pawl is attached to the first member housing.

11. The motion conversion mechanism of claim 10, wherein the at least one pawl is rotationally coupled to the first member housing.

12. The motion conversion mechanism of claim 10, wherein the at least one pawl is coupled to the first member housing to flex relative to the first member housing.

13. The motion conversion mechanism of claim 10, wherein the first gear member is coupled to the at least one ratchet to rotate with the at least one ratchet, and wherein the second gear member is configured to engage with the at least one gear and to impart rotational motion to the rotation device about the rotation axis.

14. The motion conversion mechanism of claim 13, wherein the at least one ratchet comprises a first ratchet and a second ratchet, the at least one pawl comprises a first pawl configured to engage with the first ratchet, and a second pawl configured to engage with the second ratchet, and wherein when the first member moves in the first angular direction, the first pawl engages the first ratchet so as to prevent rotation of the first ratchet and the second pawl allows rotation of the second ratchet, and when the first member moves in the second angular direction, the second pawl engages the second ratchet so as to prevent rotation of the second ratchet and the first pawl allows rotation of the first ratchet.

15. The motion conversion mechanism of claim 14, wherein the first member further comprises a ratchet axle fixed to the first member housing, wherein the at least one ratchet is configured to rotate about the ratchet axle.

16. The motion conversion mechanism of claim 13, wherein the first and second gear members are crown gears or spur gears.

17. The motion conversion mechanism of claim 13, wherein the first and second gear members are bevel gears.

18. The motion conversion mechanism of claim 13, wherein the second member further comprises a second member housing.

19. The motion conversion mechanism of claim 18, wherein the second member housing is pivotably connected to the first member housing.

20. The motion conversion mechanism of claim 13, further comprising:

a torque limiting clutch associated with the rotation device and the second gear member such that excessive torque applied to the rotation device is not transferred to the second gear member.

21. The motion conversion mechanism of claim 1, wherein the motion conversion mechanism comprises a mobile attached to the rotation device.

22. A motion conversion mechanism for use with a child containment structure, the motion conversion mechanism comprising:

a first member configured to be arranged relative to the child containment structure to undergo motion about an angular motion axis in a first angular direction and in a second angular direction opposite to the first angular direction;

a second member carrying a rotation device that is rotatable relative to the first member about a rotation axis;

a first pawl and a second pawl , both pawls carried by the first member; and a first ratchet and a second ratchet rotatable with respect to the first ratchet, wherein the first and second ratchets are configured to engage the first pawl and the second pawl, respectively, wherein movement of the first member in the first angular direction causes the first pawl to engage the first ratchet so as to prevent rotation of the first ratchet and the second pawl to disengage from the second ratchet so as to allow rotation of the second ratchet, and movement of the first member in the second angular direction causes the second pawl to engage the second ratchet so as to prevent rotation of the second ratchet and the first pawl to disengage from the first ratchet to allow rotation of the first ratchet.

23. The motion conversion mechanism of claim 22, wherein the second member further comprises a second member gear in communication with the first and second ratchets, wherein movement of the first member in the angular direction causes the second member gear to rotate about the rotation axis.

24. The motion conversion mechanism of claim 23, wherein the second member gear carries the rotation device.

25. The motion conversion mechanism of claim 24, further comprising first and second ratchet gears rotatably coupled to the first and second ratchets, respectively, wherein the first and second ratchet gears engage the second member gear.

26. The motion conversion mechanism of claim 22, wherein the motion conversion mechanism comprises a mobile attached to the rotation device.

27. The motion conversion mechanism of claim 22, wherein the first and second ratchets convert the angular motion of the first member to rotation of the rotation device when the first member moves both in the first angular direction and in the second angular direction.

28. A child entertainment structure comprising:

a support adapted to undergo motion about an angular axis in a first angular direction and a second angular direction opposite to the first angular direction; and a motion conversion mechanism comprising:

a first member attached to the support, the first member including at least one ratchet and at least one pawl configured to engage the ratchet in one direction of motion and to disengage the ratchet in a second direction of motion;

a second member including a rotation device that is rotatable about a rotation axis, the rotation axis extending in a direction that is not parallel to the angular axis, wherein the pawl and ratchet convert motion of the first member about the angular motion axis to motion of the rotation device about the rotation axis.

29. The child entertainment structure of claim 28, further comprising:

a swing frame, and wherein the support comprises one of a swing seat and a swing seat support supported by the swing frame.

30. The child entertainment structure of claim 29, wherein the swing seat support comprises a hanger arm.

31. The child entertainment structure of claim 28, wherein the child entertainment structure comprises a bassinet, and the support comprises a child support surface.

32. The child entertainment structure of claim 28, wherein the child entertainment structure comprises a rocking chair including a seat.

33. The child entertainment structure of claim 28, wherein the motion conversion mechanism comprises a mobile attached to the rotation device.

34. The motion conversion mechanism of claim 28, wherein the first and second members convert motion about the angular motion axis to motion of the rotation device about the rotation axis when the support moves both in the first angular direction and in the second angular direction.

35. A motion conversion mechanism for use with a child containment structure, the motion conversion mechanism comprising:

a first member configured to be arranged relative to the child containment structure to undergo motion in a first angular direction and in a second angular direction opposite to the first angular direction;

at least one ratchet defining a plurality of ratchet teeth, and at least one pawl in communication with the first member, the pawl configured to engage the ratchet in one direction to prevent rotation of the ratchet, and to disengage and slide along the ratchet teeth in a second direction opposite the first direction to permit rotation of the ratchet; and a second member including a rotation device that is rotatable about a rotation axis, the second member in communication with the ratchet, such that the angular motion of the first member is converted to motion of the rotation device about the rotation axis when the first member moves both in the first angular direction and in the second angular direction.

* * * * *